US010639653B1

(12) United States Patent
Shook

(10) Patent No.: US 10,639,653 B1
(45) Date of Patent: May 5, 2020

(54) AIR OUTLET DEVICE

(71) Applicant: AirBTU, Inc., Worthington, OH (US)

(72) Inventor: James Richard Shook, Palm Springs, CA (US)

(73) Assignee: AirBTU, Inc., Worthington, OH (US)

( * ) Notice: Subject to any disclaimer, the term of this patent is extended or adjusted under 35 U.S.C. 154(b) by 43 days.

(21) Appl. No.: 15/892,289

(22) Filed: Feb. 8, 2018

Related U.S. Application Data

(60) Provisional application No. 62/456,886, filed on Feb. 9, 2017.

(51) Int. Cl.
*B05B 1/04* (2006.01)
*F26B 21/00* (2006.01)
*B05B 1/00* (2006.01)

(52) U.S. Cl.
CPC ..... *B05B 1/048* (2013.01); *B05B 1/044* (2013.01); *B05B 1/005* (2013.01); *F26B 21/004* (2013.01)

(58) Field of Classification Search
CPC ..... B05B 1/005; B05B 1/044; B05B 1/048; F26B 21/004; B05C 11/06
See application file for complete search history.

(56) References Cited

U.S. PATENT DOCUMENTS 2,139,628 A 12/1938 Terry
3,272,176 A 9/1966 Saydlowski
3,984,054 A 10/1976 Frochaux
4,041,895 A * 8/1977 Overton ..... B05C 11/06 118/704
D277,403 S 1/1985 Wilson
4,515,313 A 5/1985 Cavanagh
5,268,727 A 12/1993 Thayer et al.
(Continued)

FOREIGN PATENT DOCUMENTS

EP 0041729 B1 12/1981

OTHER PUBLICATIONS

"Quieter by design—air knives", Health and Safety Executive (HSE) Website, Web page <http://www.hse.gov.uk/noise/casestudies/soundsolutions/airknives.htm>, 2 pages, dated at least as early as Sep. 2016, retrieved from www.hse.gov.uk website on Aug. 18, 2019.

(Continued)

*Primary Examiner* — Darren W Gorman
(74) *Attorney, Agent, or Firm* — The Law Office of Patrick F. O'Reilly III, LLC

(57) ABSTRACT

An air outlet device is disclosed herein. The air outlet device includes a plenum body portion, the plenum body portion defining an air chamber therein, the plenum body portion including an air inlet configured to be coupled to a supply air source for supplying air to the air chamber; an air nozzle portion fluidly coupled to the plenum body portion and including a nozzle inlet and an exit orifice, the air nozzle portion configured to discharge the air from the air chamber at a substantially uniform velocity through the exit orifice; and an air nozzle extension fluidly coupling the air chamber of the plenum body portion to the nozzle inlet of the air nozzle portion, the air nozzle extension being configured to increase an efficiency of the air outlet device by decreasing the pressure drop that occurs when the pressure energy of the air is converted to kinetic energy.

18 Claims, 7 Drawing Sheets

(56) References Cited

U.S. PATENT DOCUMENTS

| | | | | |
|---|---|---|---|---|
| 5,782,414 | A | 7/1998 | Nathenson | |
| 6,990,751 | B2 * | 1/2006 | Riley | F26B 21/004 34/236 |
| 8,382,013 | B2 * | 2/2013 | Pucciani | B05B 1/005 239/597 |
| 8,814,067 | B2 * | 8/2014 | Freers | F26B 21/004 239/548 |
| 2003/0115709 | A1 * | 6/2003 | Haruch | B08B 5/023 15/309.2 |
| 2013/0251545 | A1 | 9/2013 | VanderPyl | |
| 2013/0333732 | A1 * | 12/2013 | Kaske | B05B 1/044 134/34 |

OTHER PUBLICATIONS

Case Studies Webpage, Pearson Website, Web page <http://wps.prenhall.com/chet_lockhart_engineer_1/42/10874/2783997.cw/-/2784022/index.html>, 7 pages, dated at least as early as Sep. 2016, retrieved from wps.prenhall.com website on Aug. 18, 2019.

Linear Air Knives | Secomak Webpage, Industry Search Website, Web page <https://www.industrysearch.com.au/linear-air-knives-secomak/p/95479>, 6 pages, dated at least as early as Sep. 2016, retrieved from www.industrysearch.com.au website on Aug. 19, 2019.

* cited by examiner

AIR OUTLET DEVICE

CROSS-REFERENCE TO RELATED APPLICATIONS

This patent application claims priority to, and incorporates by reference in its entirety, U.S. Provisional Patent Application No. 62/456,886, entitled "Air Outlet Device", filed on Feb. 9, 2017.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to an air outlet device. More particularly, the invention relates to an air outlet device in the form of an air knife used in industrial applications.

2. Background and Description of Related Art

Air outlet devices in the form of air knives are used in a wide variety of applications, such as drying or cooling surfaces, including conveyors, where a continuous wide area air jet is required. Air knife systems (also called strip dryers or air blow-off systems) are significant consumers of energy in many industrial processes. They present an industrial process design problem of requiring large amounts of power (particularly when consuming compressed air) and production space, but they are necessary components in the process.

Air knives are used in these applications because they generate a highly uniform, high speed air jet along the entire width of the air knife length. The energy required to create this uniform, high speed jet is typically provided by some type of air compressor which compresses the air to a relatively high pressure, or by a fan that moves a high volume of air at a low pressure. As the air passes through the air knife, the pressure is converted into kinetic energy for removing or smoothing out liquids on a continuously moving surface.

Therefore, what is needed is an air outlet device that has a higher efficiency than conventional devices so that the power consumption of the air outlet device is significantly reduced. Moreover, an air outlet device is needed that is capable of operating at a higher efficiency, while still remaining compact so as to satisfy system space constraints. Furthermore, there is a need for an air outlet device that is capable of producing highly uniform air jets with substantially reduced pressure drops.

BRIEF SUMMARY OF EMBODIMENTS OF THE INVENTION

Accordingly, the present invention is directed to an air outlet device that substantially obviates one or more problems resulting from the limitations and deficiencies of the related art.

In accordance with one or more embodiments of the present invention, there is provided an air outlet device that includes a plenum body portion, the plenum body portion defining an air chamber therein, the plenum body portion including an air inlet configured to be coupled to a supply air source for supplying air to the air chamber; an air nozzle portion fluidly coupled to the plenum body portion, the air nozzle portion including a nozzle inlet and an exit orifice, the air nozzle portion configured to discharge the air from the air chamber at a substantially uniform velocity through the exit orifice; and an air nozzle extension fluidly coupling the air chamber of the plenum body portion to the nozzle inlet of the air nozzle portion, the air nozzle extension being configured to increase an efficiency of the air outlet device by decreasing the pressure drop that occurs when the pressure energy of the air is converted to kinetic energy.

In a further embodiment of the present invention, the air nozzle extension is internally disposed within the air outlet device so as to not result in an increased height of the air outlet device beyond that which is required to accommodate the plenum body portion and the air nozzle portion.

In yet a further embodiment, the air nozzle extension comprises a curved wall section fluidly coupled to the air chamber of the plenum body portion and a straight wall section disposed downstream of the curved wall section, the straight wall section being fluidly coupled to the nozzle inlet of the air nozzle portion.

In still a further embodiment, the curved wall section and the straight wall section of the air nozzle extension project into the air chamber of the plenum body portion.

In yet a further embodiment, a radius of the curved wall section of the air nozzle extension is substantially greater than a width of the nozzle inlet.

In still a further embodiment, the air nozzle extension comprises a curved wall section attached to a wall portion of the plenum body portion.

In yet a further embodiment, a radius of the curved wall section of the air nozzle extension is substantially greater than a width of the nozzle inlet.

In still a further embodiment, the air nozzle portion comprises a substantially straight wall section fluidly coupled to the air nozzle extension and a tapered wall section disposed downstream of the substantially straight wall section, the tapered wall section of the air nozzle portion comprising the exit orifice at a downstream end thereof.

In yet a further embodiment, the plenum body portion is elongate with a length that is substantially greater than a width or a height thereof.

In still a further embodiment, the plenum body portion has a first end and a second end oppositely disposed relative to the first end, and wherein the plenum body portion comprises one or more inlet collars disposed at respective ones of the first and second ends, the one or more inlet collars defining the air inlet of the plenum body portion, and the one or more inlet collars configured to connect to an air supply line.

In yet a further embodiment, the plenum body portion has a circular, elliptical, or polygonal cross-sectional shape.

In accordance with one or more other embodiments of the present invention, there is provided an air outlet device that includes a plenum body portion, the plenum body portion defining an air chamber therein, the plenum body portion including an air inlet configured to be coupled to a supply air source for supplying air to the air chamber; an air nozzle portion fluidly coupled to the plenum body portion, the air nozzle portion including a nozzle inlet and an exit orifice, the air nozzle portion configured to discharge the air from the air chamber at a substantially uniform velocity through the exit orifice; and an air nozzle extension fluidly coupling the air chamber of the plenum body portion to the nozzle inlet of the air nozzle portion, the air nozzle extension being internally disposed within the air outlet device so as to not result in an increased height of the air outlet device beyond that which is required to accommodate the plenum body portion and the air nozzle portion, the air nozzle extension being configured to increase an efficiency of the air outlet device by decreasing the pressure drop that occurs when the pressure energy of the air is converted to kinetic energy.

In a further embodiment of the present invention, the air nozzle extension comprises a curved wall section fluidly coupled to the air chamber of the plenum body portion and a straight wall section disposed downstream of the curved wall section, the straight wall section being fluidly coupled to the nozzle inlet of the air nozzle portion.

In yet a further embodiment, the curved wall section and the straight wall section of the air nozzle extension project into the air chamber of the plenum body portion.

In still a further embodiment, a radius of the curved wall section of the air nozzle extension is substantially greater than a width of the nozzle inlet.

In yet a further embodiment, the air nozzle extension comprises a curved wall section attached to a wall portion of the plenum body portion.

In still a further embodiment, a radius of the curved wall section of the air nozzle extension is substantially greater than a width of the nozzle inlet.

In yet a further embodiment, the air nozzle portion comprises a substantially straight wall section fluidly coupled to the air nozzle extension and a tapered wall section disposed downstream of the substantially straight wall section, the tapered wall section of the air nozzle portion comprising the exit orifice at a downstream end thereof.

In still a further embodiment, the plenum body portion is elongate with a length that is substantially greater than a width or a height thereof.

In yet a further embodiment, the plenum body portion has a first end and a second end oppositely disposed relative to the first end, and wherein the plenum body portion comprises one or more inlet collars disposed at respective ones of the first and second ends, the one or more inlet collars defining the air inlet of the plenum body portion, and the one or more inlet collars configured to connect to an air supply line.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 5:
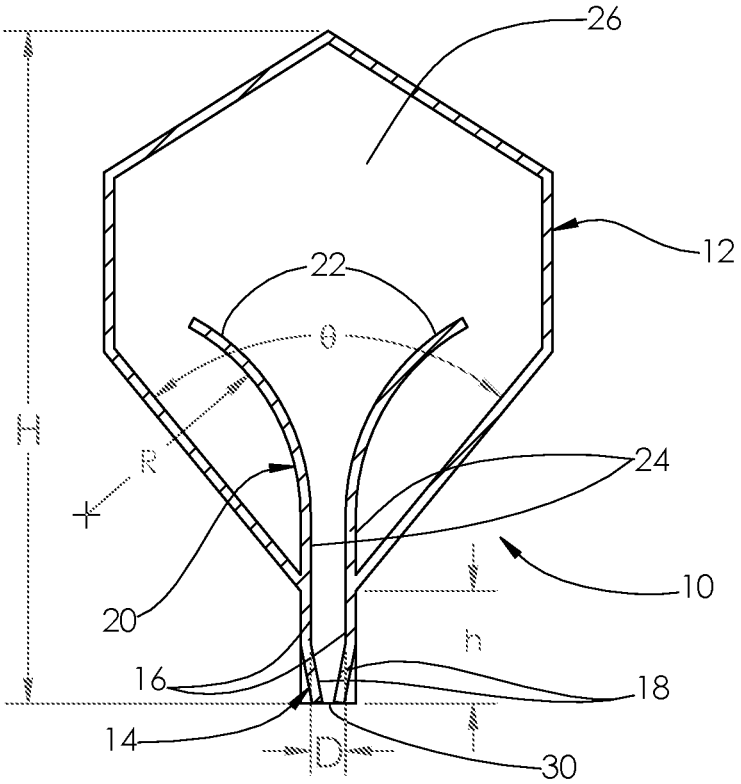
FIG. 5 is a transverse sectional view of the air outlet device of FIG. 1, wherein the section is generally cut along the cutting-plane line 5-5 in FIG. 1.
Figure 6:
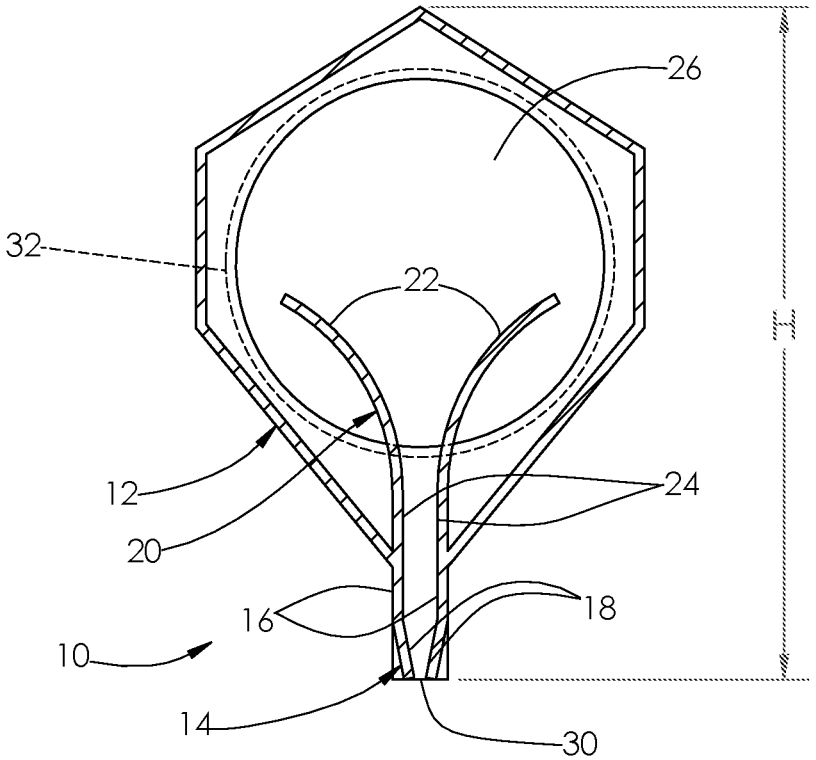
FIG. 6 is another transverse sectional view of the air outlet device of FIG. 1, wherein the line of sight is opposite to that which is illustrated in FIG. 5.

A first illustrative embodiment of an air outlet device is seen generally at 10 in FIGS. 1-7. In the first illustrative embodiment, referring initially to FIGS. 1 and 5, the air outlet device 10 generally comprises (i) a plenum body portion 12, the plenum body portion 12 defining an air chamber 26 therein, the plenum body portion 12 including an air inlet opening 28 configured to be coupled to a supply air source for supplying air to the air chamber 26; (ii) an air nozzle portion 14 fluidly coupled to the plenum body portion 12, the air nozzle portion 14 including a nozzle inlet and an exit orifice 30, the air nozzle portion 14 configured to discharge the air from the air chamber 26 at a substantially uniform velocity through the exit orifice 30; and (iii) an air nozzle extension 20 fluidly coupling the air chamber 26 of the plenum body portion 12 to the nozzle inlet of the air nozzle portion 14, the air nozzle extension 20 being configured to increase an efficiency of the air outlet device 10 by decreasing the pressure drop that occurs when the pressure energy of the air is converted to kinetic energy. In the illustrative embodiment, as shown in FIGS. 5 and 6, the air nozzle extension 20 is internally disposed within the air outlet device 10 so as to not result in an increased height of the air outlet device 10 beyond that which is required to accommodate the plenum body portion 12 and the air nozzle portion 14. In an exemplary embodiment, the air outlet device 10 may have a height of approximately 10 inches or less, which is compact enough to fit in most industrial applications. However, one of ordinary skill in the art will recognize that other suitable heights may be used as well.

Figure 1:
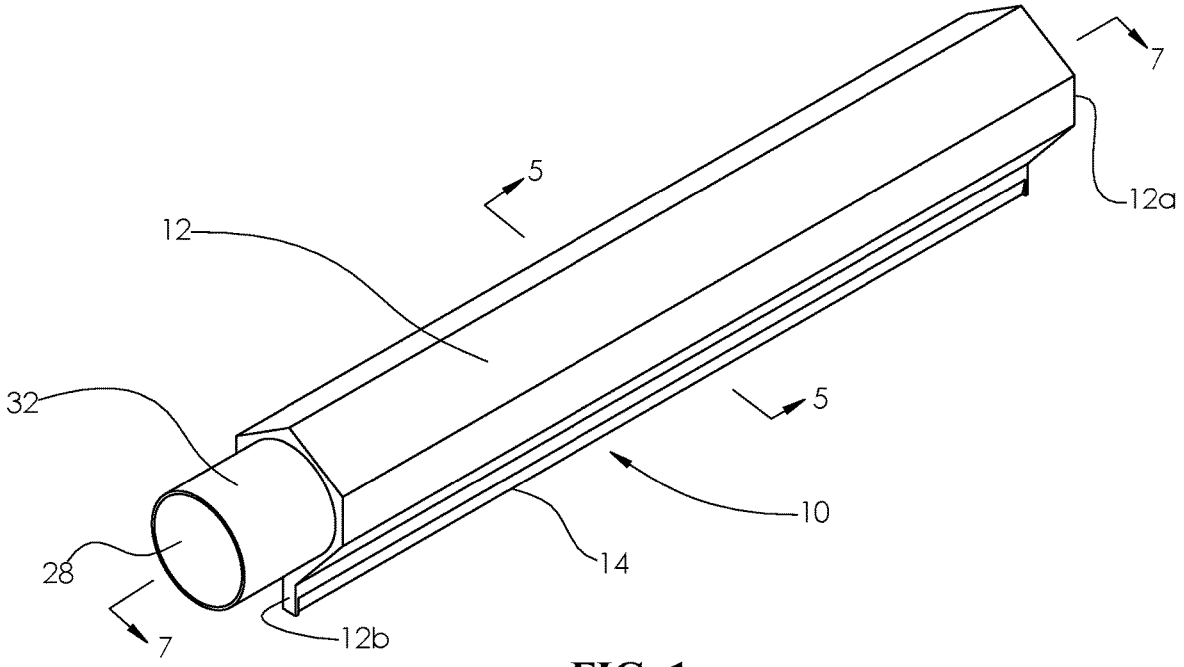
FIG. 1 is a perspective view of an air outlet device according to a first embodiment of the invention.
Figure 2:
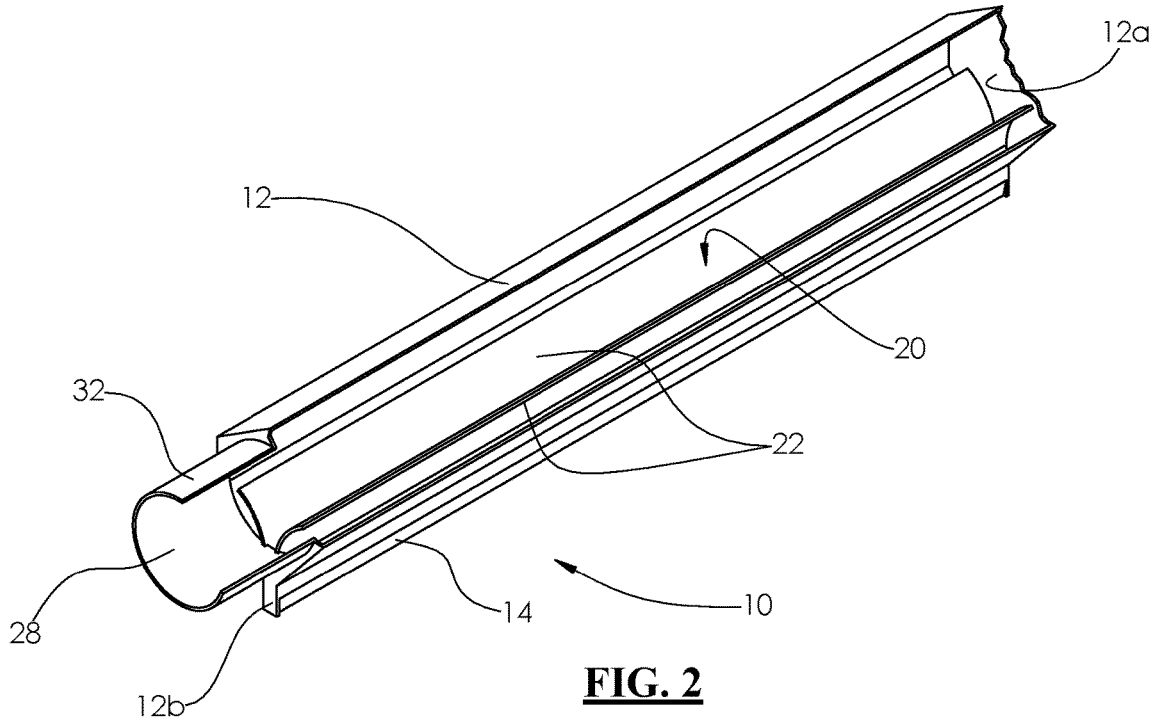
FIG. 2 is a cut-away perspective view of the air outlet device of FIG. 1, wherein the structure of the air nozzle extension of the air outlet device is illustrated.
Figure 3:
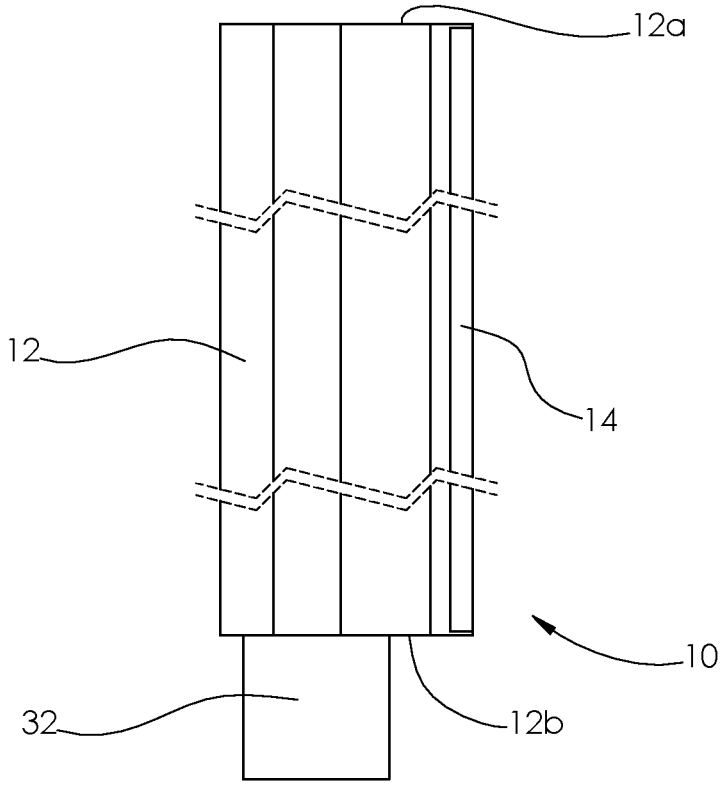
FIG. 3 is a partial side view of the air outlet device of FIG. 1.
Figure 4:
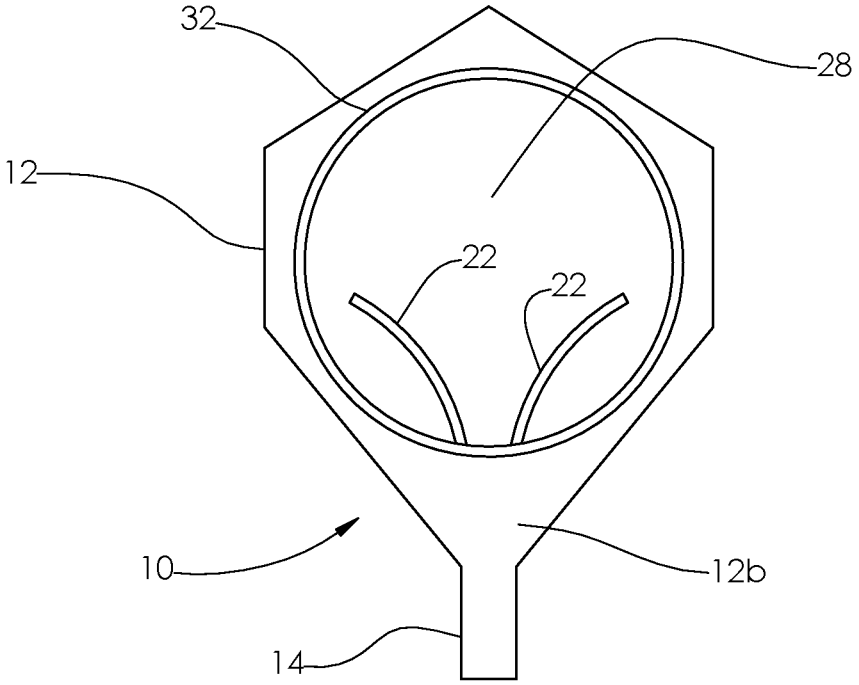
FIG. 4 is an end view of the air outlet device of FIG. 1.
Figure 7:
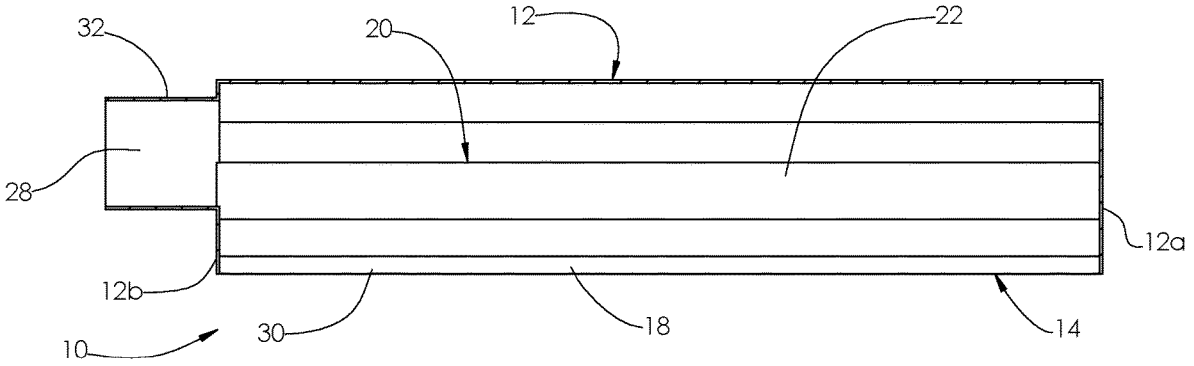
FIG. 7 is a longitudinal sectional view of the air outlet device of FIG. 1, wherein the section is generally cut along the cutting-plane line 7-7 in FIG. 1.

Now, with particular reference to FIGS. 1, 2, and 7, the plenum body portion 12 of the air outlet device 10 will be described in further detail. As shown in these figures, the plenum body portion 12 of the air outlet device 10 is elongate with a length that is substantially greater than a width or a height thereof. Also, as shown in these figures, the plenum body portion 12 has a first end 12*a* and a second end 12*b* oppositely disposed relative to the first end 12*a*. In the illustrative embodiment, the plenum body portion 12 has a solid end wall disposed at the first end 12*a* thereof and an inlet collar 32 disposed at the second end 12*b* thereof that defines the air inlet opening 28 of the plenum body portion 12. The inlet collar 32 is configured to connect to an air supply line of the supply air source (e.g., a compressor or fan) for supplying air to the air chamber 26 of air outlet device 10. In the illustrative embodiment, the plenum body portion 12 has a polygonal cross-sectional shape (i.e., a generally hexagonal cross-sectional shape). However, in other embodiments, the plenum body portion 12 of the air outlet device 10 may have other suitable cross-sectional shapes as well, such as a circular or elliptical shape.

Also, as best shown in FIG. 5, the downwardly sloped walls of the polygonal plenum body portion 12 of the air outlet device 10 are disposed at an angle θ relative to one another. In an exemplary embodiment, the angle θ defined between the two downwardly sloped walls of the polygonal plenum body portion 12 may be equal to approximately 45 degrees in order to minimize the discharge coefficient $C_0$ of the air outlet device 10. Advantageously, by minimizing the discharge coefficient $C_0$ of the air outlet device 10, the discharge velocity of the air outlet device 10 is maximized.

Next, referring to FIGS. 1, 5, and 6, the details of the air nozzle portion 14 of the air outlet device 10 will be explained. As best shown in FIGS. 5 and 6, the air nozzle portion 14 comprises a substantially straight wall section 16 fluidly coupled to the air nozzle extension 20 and a tapered wall section 18 disposed downstream of the substantially straight wall section 16. The tapered wall section 18 of the air nozzle portion 14 contains the exit orifice 30 at the downstream end thereof. As a result of the converging geometry of the air nozzle portion 14 of the air outlet device 10, the pressure energy of the air is converted to kinetic energy as it passes through the nozzle, thereby resulting in an increased velocity of the air at the exit orifice 30 of the air outlet device 10.

Now, with combined reference to FIGS. 2, 5 and 6, the air nozzle extension 20 of the air outlet device 10 will be described in detail. As illustrated in these figures, the air nozzle extension 20 comprises a convex curved wall section 22 fluidly coupled to the air chamber 26 of the plenum body portion 12 and a straight wall section 24 disposed downstream of the curved wall section 22. The straight wall section 24 of the air nozzle extension 20 is fluidly coupled to the nozzle inlet of the air nozzle portion 14 defined by the straight wall section 16 of the air nozzle portion 14. As depicted in the first illustrative embodiment of FIGS. 5 and 6, the curved wall section 22 and the straight wall section 24 of the air nozzle extension 20 project into the air chamber 26 of the plenum body portion 12 so as to obviate the need for increasing the overall height of the air outlet device 10. In the illustrative embodiment, a radius R of the curved wall section 22 of the air nozzle extension 20 is substantially greater than a width D of the nozzle inlet (see FIG. 5) so as to result in a gradual transition into the air nozzle portion 14 of the air outlet device 10. In the illustrative embodiment, as shown by the following equation, the ratio of the height h of the air nozzle portion 14 to the overall height H of the air outlet device 10 (i.e., the h/H ratio) may be between 0.20 and 0.30 in order to maximize the efficiency of the air outlet device 10, while maintaining a compact design:

$$0.20 \le \frac{h}{H} \le 0.30 \tag{1}$$

Also, in the illustrative embodiment, as shown by the following equation, the ratio of the width D of the nozzle inlet to the overall height H of the air outlet device 10 (i.e., the D/H ratio) may be between 0.10 and 0.25 in order to maximize the efficiency of the air outlet device 10, while maintaining a compact design:

$$0.10 \le \frac{D}{H} \le 0.25 \tag{2}$$

Further, the pressure $p_1$ in the air chamber 26 of the plenum body portion 12 of the air outlet device 10 is given by the following equation:

$$p_1 = C_0 * p_{vel} \tag{3}$$

where: $C_0$ is the discharge coefficient for the air outlet device 10; and $p_{vel}$ is the discharge velocity of the air outlet device 10.

The following table gives discharge coefficient values that correspond to various values of the ratio of the radius R of the curved wall section 22 of the air nozzle extension 20 to the width D of the nozzle inlet (i.e., the R/D ratio):

TABLE 1

Discharge Coefficient Values For Various R/D Ratio Values (First Embodiment)

| R/D | $C_0$ | R/D | $C_0$ |
|---|---|---|---|
| 0 | 0.5 | 0.06 | 0.20 |
| 0.01 | 0.44 | 0.08 | 0.15 |
| 0.02 | 0.37 | 0.10 | 0.12 |
| 0.03 | 0.31 | 0.12 | 0.09 |
| 0.04 | 0.26 | 0.16 | 0.06 |
| 0.05 | 0.22 | ≥0.20 | 0.03 |

As shown in Table 1 above, the discharge coefficient $C_0$ continually decreases as the R/D ratio for the air outlet device 10 increases until reaching an R/D ratio of 0.20. For R/D ratios exceeding 0.20, the discharge coefficient $C_0$ only decreases very slightly. As such, in the illustrative embodiment, the air outlet device 10 has an R/D ratio of at least 0.20 in order to minimize the discharge coefficient $C_0$ of the air outlet device 10, thereby maximizing the discharge velocity of the air outlet device 10.

A second illustrative embodiment of the air outlet device is seen generally at 50 in FIGS. 8-14. Referring to these figures, it can be seen that, in many respects, the second illustrative embodiment is similar to that of the first illustrative embodiment. Moreover, many elements are common to both such embodiments. For the sake of brevity, the elements that the second embodiment of the air outlet device has in common with the first embodiment will not be discussed in detail because these components have already been described above.

Figure 12:
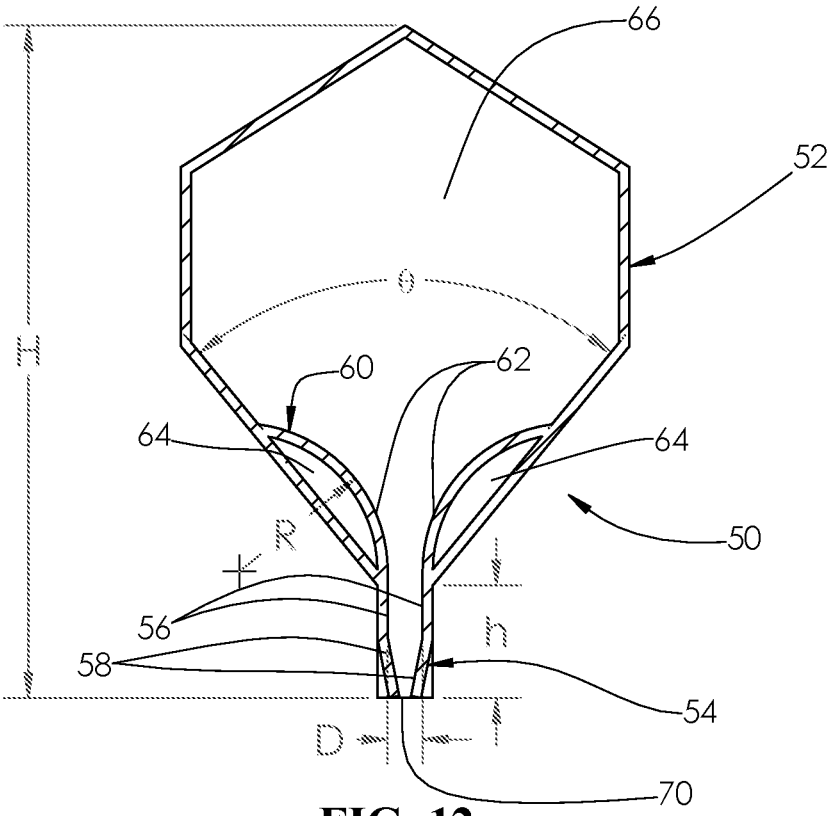
FIG. 12 is a transverse sectional view of the air outlet device of FIG. 8, wherein the section is generally cut along the cutting-plane line 12-12 in FIG. 8.
Figure 13:
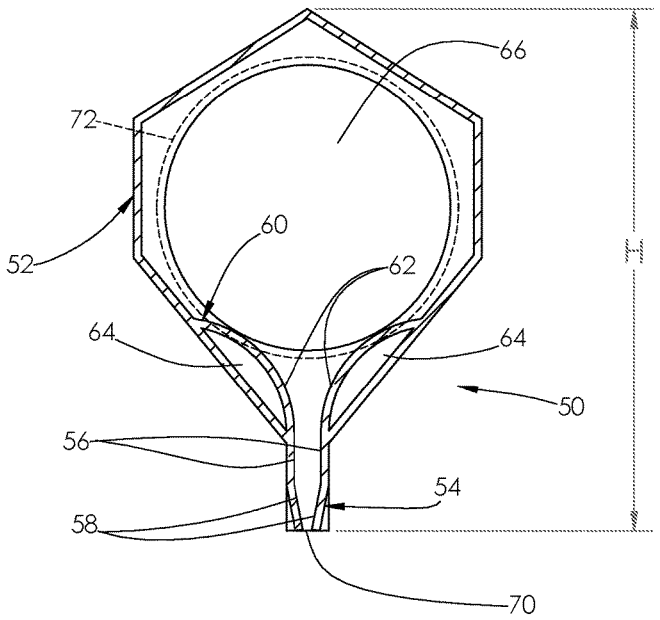
FIG. 13 is another transverse sectional view of the air outlet device of FIG. 8, wherein the line of sight is opposite to that which is illustrated in FIG. 12.

Like the air outlet device 10 described above, the air outlet device 50 of the second illustrative embodiment generally comprises (i) a plenum body portion 52 (see e.g., FIG. 1), the plenum body portion 52 defining an air chamber 66 therein (see e.g., FIG. 12), the plenum body portion 52 including an air inlet opening 68 configured to be coupled to a supply air source for supplying air to the air chamber 66; (ii) an air nozzle portion 54 fluidly coupled to the plenum body portion 52, the air nozzle portion 54 including a nozzle inlet and an exit orifice 70, the air nozzle portion 54 configured to discharge the air from the air chamber 66 at a substantially uniform velocity through the exit orifice 70; and (iii) an air nozzle extension 60 fluidly coupling the air chamber 66 of the plenum body portion 52 to the nozzle inlet of the air nozzle portion 54, the air nozzle extension 60 being configured to increase an efficiency of the air outlet device 50 by decreasing the pressure drop that occurs when the pressure energy of the air is converted to kinetic energy. In the illustrative embodiment, as shown in FIGS. 12 and 13, the air nozzle extension 60 is internally disposed within the air outlet device 50 so as to not result in an increased height of the air outlet device 50 beyond that which is required to accommodate the plenum body portion 52 and the air nozzle portion 54. In an exemplary embodiment, the air outlet device 50 may have a height of approximately 10 inches or less, which is compact enough to fit in most industrial applications. However, one of ordinary skill in the art will recognize that other suitable heights may be used as well.

Figure 8:
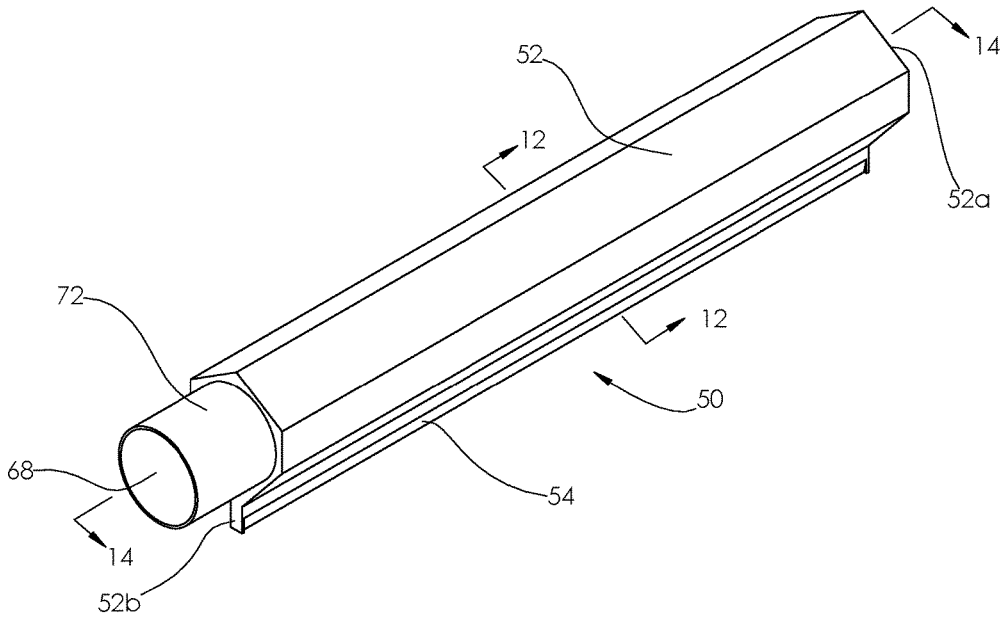
FIG. 8 is a perspective view of an air outlet device according to a second embodiment of the invention.
Figure 9:
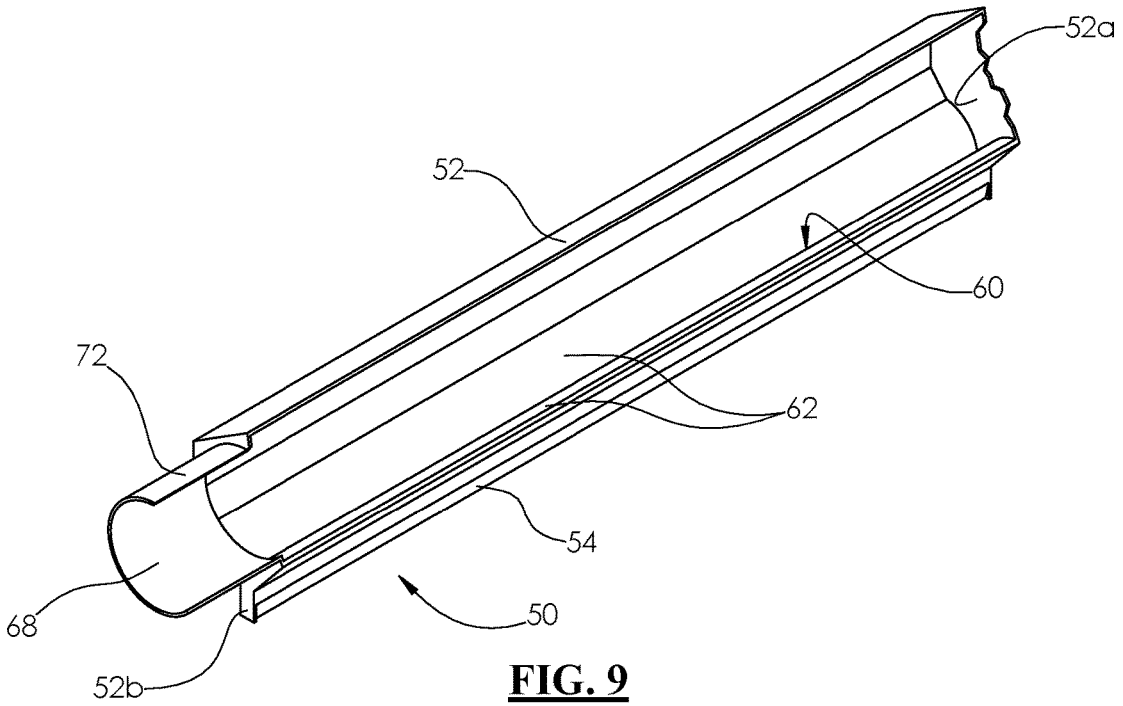
FIG. 9 is a cut-away perspective view of the air outlet device of FIG. 8, wherein the structure of the air nozzle extension of the air outlet device is illustrated.
Figure 10:
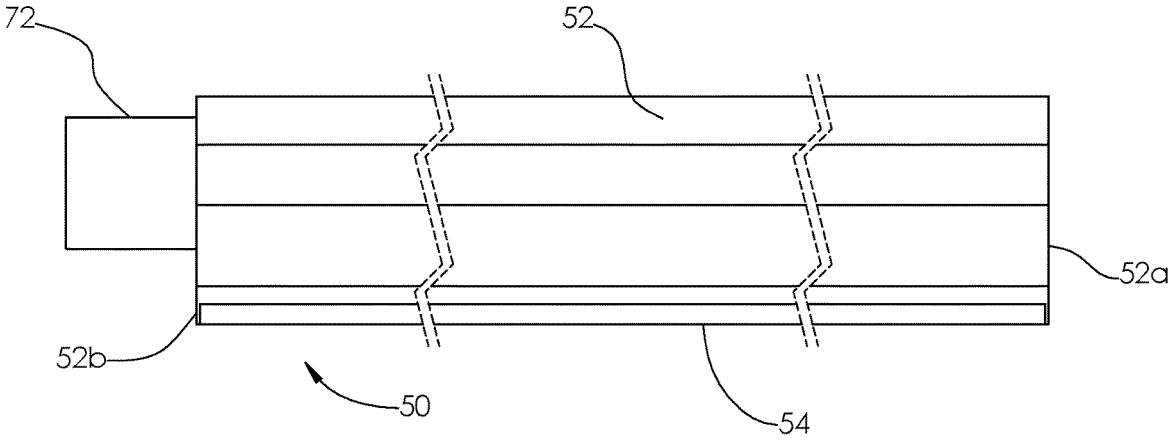
FIG. 10 is a partial side view of the air outlet device of FIG. 8.
Figure 11:
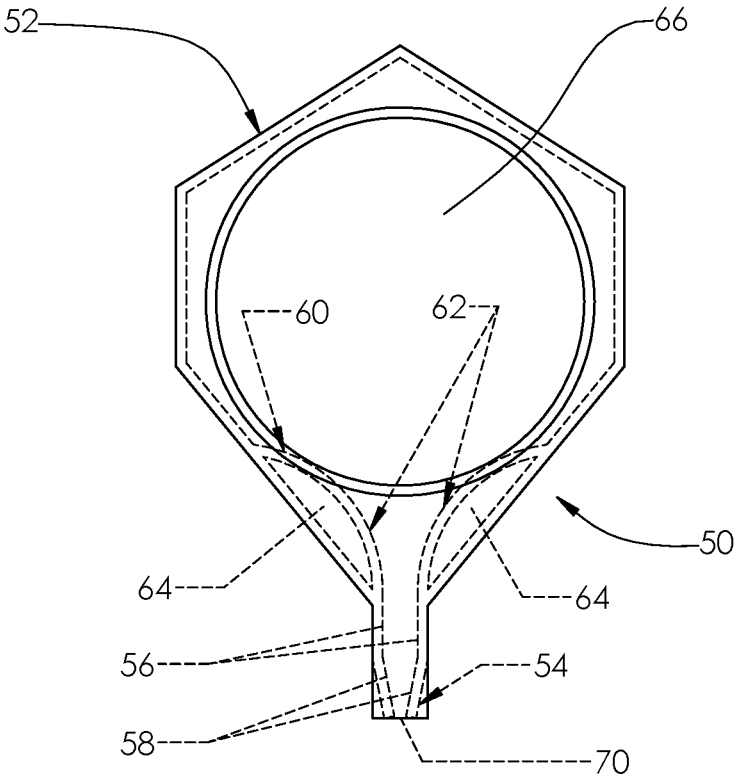
FIG. 11 is an end view of the air outlet device of FIG. 8.
Figure 14:
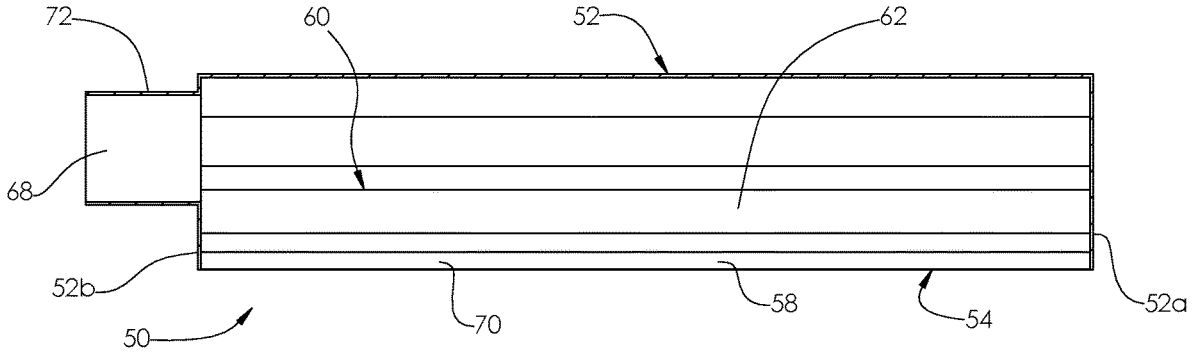
FIG. 14 is a longitudinal sectional view of the air outlet device of FIG. 8, wherein the section is generally cut along the cutting-plane line 14-14 in FIG. 8.

Now, with particular reference to FIGS. 8, 9, and 14, the plenum body portion 52 of the air outlet device 50 will be described in further detail. As shown in these figures, similar to that described above for the first illustrative embodiment, the plenum body portion 52 of the air outlet device 50 is elongate with a length that is substantially greater than a width or a height thereof. Also, as shown in these figures, the plenum body portion 52 has a first end 52*a* and a second end 52*b* oppositely disposed relative to the first end 52*a*. In the illustrative embodiment, the plenum body portion 52 has a solid end wall disposed at the first end 52*a* thereof and an inlet collar 72 disposed at the second end 52*b* thereof that defines the air inlet opening 68 of the plenum body portion 52. The inlet collar 72 is configured to connect to an air supply line of the supply air source (e.g., a compressor or fan) for supplying air to the air chamber 66 of air outlet device 50. In the illustrative embodiment, the plenum body portion 52 has a polygonal cross-sectional shape (i.e., a generally hexagonal cross-sectional shape). However, in other embodiments, the plenum body portion 52 of the air outlet device 50 may have other suitable cross-sectional shapes as well, such as a circular or elliptical shape.

Also, as best shown in FIG. 12, the downwardly sloped walls of the polygonal plenum body portion 52 of the air outlet device 50 are disposed at an angle θ relative to one another. In an exemplary embodiment, the angle θ defined between the two downwardly sloped walls of the polygonal plenum body portion 52 may be equal to approximately 45 degrees in order to minimize the discharge coefficient $C_0$ of the air outlet device 50. Advantageously, by minimizing the discharge coefficient $C_0$ of the air outlet device 50, the discharge velocity of the air outlet device 50 is maximized.

Next, referring to FIGS. 8, 12, and 13, the details of the air nozzle portion 54 of the air outlet device 50 will be explained. As best shown in FIGS. 12 and 13, the air nozzle portion 54 comprises a substantially straight wall section 56 fluidly coupled to the air nozzle extension 60 and a tapered wall section 58 disposed downstream of the substantially straight wall section 56. The tapered wall section 58 of the air nozzle portion 54 contains the exit orifice 70 at the downstream end thereof. As a result of the converging geometry of the air nozzle portion 54 of the air outlet device 50, the pressure energy of the air is converted to kinetic energy as it passes through the nozzle, thereby resulting in an increased velocity of the air at the exit orifice 70 of the air outlet device 50.

Now, with combined reference to FIGS. 8, 12, and 13, the air nozzle extension 60 of the air outlet device 50 will be described in detail. Unlike the first illustrative embodiment, the air nozzle extension 60 of the second illustrative embodiment is mounted against the wall of the plenum body portion 52, rather than projecting into the air chamber of the plenum body portion (see e.g., FIGS. 12 and 13). In particular, as illustrated in FIGS. 12 and 13, the air nozzle extension 60 comprises a convex curved wall 62 attached to a wall portion of the plenum body portion 52. The curved wall 62 of the air nozzle extension 60 is fluidly coupled to the nozzle inlet of the air nozzle portion 54 defined by the straight wall section 56 of the air nozzle portion 54. As depicted in the second illustrative embodiment of FIGS. 12 and 13, the curved wall 62 of the air nozzle extension 60 is attached to the interior surface of the wall of the plenum body portion 52 so as to obviate the need for increasing the overall height of the air outlet device 50. In the lower region of the plenum body portion 52 where the curved wall 62 of the air nozzle extension 60 is attached to the interior surface of the plenum wall, the plenum body portion 52 comprises a double wall section with a wall cavity 64 formed between the curved wall 62 of the air nozzle extension 60 and the outer wall of the plenum body portion 52. In the illustrative embodiment, a radius R of the curved wall 62 of the air nozzle extension 60 is substantially greater than a width D of the nozzle inlet (see FIG. 12) so as to result in a gradual transition into the air nozzle portion 54 of the air outlet device 50. In the illustrative embodiment, as shown by the following equation, the ratio of the height h of the air nozzle portion 54 to the overall height H of the air outlet device 50 (i.e., the h/H ratio) may be between 0.20 and 0.30 in order to maximize the efficiency of the air outlet device 50, while maintaining a compact design:

$$0.20 \le \frac{h}{H} \le 0.30 \tag{4}$$

Also, in the illustrative embodiment, as shown by the following equation, the ratio of the width D of the nozzle inlet to the overall height H of the air outlet device 50 (i.e., the D/H ratio) may be between 0.10 and 0.25 in order to maximize the efficiency of the air outlet device 50, while maintaining a compact design:

$$0.10 \le \frac{D}{H} \le 0.25 \tag{5}$$

Further, the pressure $p_1$ in the air chamber 66 of the plenum body portion 52 of the air outlet device 50 is given by the following equation:

$$p_1 = C_0 * p_{vel} \tag{6}$$

where: $C_0$ is the discharge coefficient for the air outlet device 50; and $p_{vel}$ is the discharge velocity of the air outlet device 50.

The following table gives discharge coefficient values that correspond to various values of the ratio of the radius R of the curved wall 62 of the air nozzle extension 60 to the width D of the nozzle inlet (i.e., the R/D ratio):

TABLE 2

Discharge Coefficient Values For Various R/D Ratio Values (Second Embodiment)

| R/D | $C_0$ | R/D | $C_0$ |
|---|---|---|---|
| 0 | 0.5 | 0.06 | 0.20 |
| 0.01 | 0.44 | 0.08 | 0.15 |
| 0.02 | 0.37 | 0.10 | 0.12 |
| 0.03 | 0.31 | 0.12 | 0.09 |
| 0.04 | 0.26 | 0.16 | 0.06 |
| 0.05 | 0.22 | ≥0.20 | 0.03 |

As shown in Table 2 above, the discharge coefficient $C_0$ continually decreases as the R/D ratio for the air outlet device 50 increases until reaching an R/D ratio of 0.20. For R/D ratios exceeding 0.20, the discharge coefficient $C_0$ only decreases very slightly. As such, in the illustrative embodiment, the air outlet device 50 has an R/D ratio of at least 0.20 in order to minimize the discharge coefficient $C_0$ of the air outlet device 50, thereby maximizing the discharge velocity of the air outlet device 50.

Now, the functionality of the air outlet device 10, 50 described above will be explained. In the illustrated embodiments of the air outlet device 10, 50 described above, the compressed air is introduced into the air chamber 26, 66 of the plenum body portion 12, 52 of the air outlet device 10, 50 through the inlet opening 28, 68 at the second end 12*b*, 52*b* of the plenum body portion 12, 52. In alternative embodiments, the compressed air may be introduced into the air chamber 26, 66 of the plenum body portion 12, 52 from both ends of the plenum body portion 12, 52. The exit orifice 30, 70 on the bottom of this plenum body portion 12, 52, which is in the form of a small gap, extends along the length of the air outlet device 10, 50 and allows the air to escape from the orifice 30, 70. The air escaping from the orifice 30, 70 escapes in a radial direction from the air outlet device 10, 50 in a thin, uniform, high velocity jet. The width of the orifice 30, 70 is substantially smaller than the size of the plenum body portion 12, 52. This small orifice size creates a substantial pressure drop, which helps create a uniform velocity along the length of the orifice 30, 70. If this orifice 30, 70 is made too large, the pressure drop is reduced, but the velocity varies along the length of the gap which results in a highly uneven jet. Uneven jet velocity from air outlet device 10, 50 can create unwanted variations in the drying or cooling rate of products and, as a result, is undesirable. At the same time, very small orifice sizes create uniform jet velocities but they create high pressure drops. These high pressure drops result in the use of high pressure compressors and high operating costs. In the illustrated embodiments, the width of the nozzle exit orifice 30, 70 of the air outlet device 10, 50 may be between 0.10 inches and 0.12 inches in order to create a substantially uniform velocity along the length of the orifice 30, 70 without an excessively highly pressure drop.

The air outlet device 10, 50 described above utilizes the inventive internal nozzle extension 20, 60 to improve air knife efficiency, while maintaining the compact size (e.g., a height of 10 inches or less) that is necessary for industrial applications. By virtue of the inventive internal nozzle extension 20, 60, the air outlet device 10, 50 efficiently converts pressure energy to kinetic energy so to achieve a highly uniform jet with substantially reduced pressure drops, thus providing a continuous drying or cooling function with minimum power requirements.

It is readily apparent that the aforedescribed air outlet device 10, 50 offers numerous advantages. First, the air outlet device 10, 50 has a higher efficiency than conventional devices so that the power consumption of the air outlet device is significantly reduced. Secondly, the aforedescribed air outlet device 10, 50 is capable of operating at a higher efficiency, while still remaining compact so as to satisfy system space constraints. Finally, the air outlet device 10, 50 described herein is capable of producing highly uniform air jets with substantially reduced pressure drops.

Advantageously, the air outlet device 10, 50 described herein is compact and more efficient than conventional devices so that it is able to function with lower power consumption in a compact format. In the illustrative embodiment, the air outlet device 10, 50 is designed for optimum performance at medium low pressure (i.e., 3 to 5 psig). This is the ideal pressure range for high efficiency, low pressure air compressors and further reduces the power required for a specific air knife application. Also, advantageously, the aforedescribed air outlet device 10, 50 produces a higher air thrust at design pressure due to its unique internal design and construction.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. An air outlet device, comprising:

a plenum body portion, said plenum body portion defining an air chamber therein, said plenum body portion including an air inlet configured to be coupled to a supply air source for supplying air to said air chamber;

an air nozzle portion fluidly coupled to said plenum body portion, said air nozzle portion including a nozzle inlet and an exit orifice, said air nozzle portion configured to discharge said air from said air chamber at a substantially uniform velocity through said exit orifice; and an air nozzle extension fluidly coupling said air chamber of said plenum body portion to said nozzle inlet of said air nozzle portion, said air nozzle extension being configured to increase an efficiency of said air outlet device by decreasing the pressure drop that occurs when the pressure energy of said air is converted to kinetic energy;

wherein said air nozzle portion comprises a substantially straight wall section fluidly coupled to said air nozzle extension and a tapered wall section disposed downstream of said substantially straight wall section, said tapered wall section of said air nozzle portion comprising said exit orifice at a downstream end thereof.

2. The air outlet device according to claim 1, wherein said air nozzle extension is internally disposed within said air outlet device so as to not result in an increased height of said air outlet device beyond that which is required to accommodate said plenum body portion and said air nozzle portion.

3. The air outlet device according to claim 2, wherein said air nozzle extension comprises a curved wall section fluidly coupled to said air chamber of said plenum body portion and a straight wall section disposed downstream of said curved wall section, said straight wall section being fluidly coupled to said nozzle inlet of said air nozzle portion.

4. The air outlet device according to claim 3, wherein said curved wall section and said straight wall section of said air nozzle extension project into said air chamber of said plenum body portion.

5. The air outlet device according to claim 3, wherein a radius of said curved wall section of said air nozzle extension is substantially greater than a width of said nozzle inlet.

6. The air outlet device according to claim 1, wherein said air nozzle extension comprises a curved wall section attached to a wall portion of said plenum body portion.

7. The air outlet device according to claim 6, wherein a radius of said curved wall section of said air nozzle extension is substantially greater than a width of said nozzle inlet.

8. The air outlet device according to claim 1, wherein said plenum body portion is elongate with a length that is substantially greater than a width or a height thereof.

9. The air outlet device according to claim 1, wherein said plenum body portion has a first end and a second end oppositely disposed relative to said first end, and wherein said plenum body portion comprises one or more inlet collars disposed at respective ones of said first and second ends, said one or more inlet collars defining said air inlet of said plenum body portion, and said one or more inlet collars configured to connect to an air supply line.

10. The air outlet device according to claim 1, wherein said plenum body portion has a circular, elliptical, or polygonal cross-sectional shape.

11. An air outlet device, comprising:

a plenum body portion, said plenum body portion defining an air chamber therein, said plenum body portion including an air inlet configured to be coupled to a supply air source for supplying air to said air chamber;

an air nozzle portion fluidly coupled to said plenum body portion, said air nozzle portion including a nozzle inlet and an exit orifice, said air nozzle portion configured to discharge said air from said air chamber at a substantially uniform velocity through said exit orifice; and an air nozzle extension fluidly coupling said air chamber of said plenum body portion to said nozzle inlet of said air nozzle portion, said air nozzle extension being internally disposed within said air outlet device so as to not result in an increased height of said air outlet device beyond that which is required to accommodate said plenum body portion and said air nozzle portion, said air nozzle extension being configured to increase an efficiency of said air outlet device by decreasing the pressure drop that occurs when the pressure energy of said air is converted to kinetic energy;

wherein said air nozzle portion comprises a substantially straight wall section fluidly coupled to said air nozzle extension and a tapered wall section disposed downstream of said substantially straight wall section, said tapered wall section of said air nozzle portion comprising said exit orifice at a downstream end thereof.

12. The air outlet device according to claim 11, wherein said air nozzle extension comprises a curved wall section fluidly coupled to said air chamber of said plenum body portion and a straight wall section disposed downstream of said curved wall section, said straight wall section being fluidly coupled to said nozzle inlet of said air nozzle portion.

13. The air outlet device according to claim 12, wherein said curved wall section and said straight wall section of said air nozzle extension project into said air chamber of said plenum body portion.

14. The air outlet device according to claim 12, wherein a radius of said curved wall section of said air nozzle extension is substantially greater than a width of said nozzle inlet.

15. The air outlet device according to claim 11, wherein said air nozzle extension comprises a curved wall section attached to a wall portion of said plenum body portion.

16. The air outlet device according to claim 15, wherein a radius of said curved wall section of said air nozzle extension is substantially greater than a width of said nozzle inlet.

17. The air outlet device according to claim 11, wherein said plenum body portion is elongate with a length that is substantially greater than a width or a height thereof.

18. The air outlet device according to claim 11, wherein said plenum body portion has a first end and a second end oppositely disposed relative to said first end, and wherein said plenum body portion comprises one or more inlet collars disposed at respective ones of said first and second ends, said one or more inlet collars defining said air inlet of said plenum body portion, and said one or more inlet collars configured to connect to an air supply line.

* * * * *